US007976190B2

(12) United States Patent
Shen et al.

(10) Patent No.: US 7,976,190 B2
(45) Date of Patent: Jul. 12, 2011

(54) CUSTOM ASSEMBLY LIGHT-EMITTING MODULE USING PLUGS AND JACKS FOR OBTAINING VERTICAL ELECTRICAL CONNECTIONS

(75) Inventors: Che-Cheng Shen, Banciao (TW); Yen-Fu Liu, Tucheng (TW); Ching-Kun Chang, Taipei (TW); Kuo-Hsin Yeh, Sindian (TW)

(73) Assignee: Energyled Corporation, Taipei County (TW)

( * ) Notice: Subject to any disclaimer, the term of this patent is extended or adjusted under 35 U.S.C. 154(b) by 157 days.

(21) Appl. No.: 12/292,062

(22) Filed: Nov. 12, 2008

(65) Prior Publication Data

US 2010/0118564 A1 May 13, 2010

(51) Int. Cl.
*F21S 4/00* (2006.01)
*F21V 21/00* (2006.01)

(52) U.S. Cl. ..... 362/249.02; 362/311.02; 362/800

(58) Field of Classification Search ..... 362/223–225, 362/249.02, 311.02, 555, 800
See application file for complete search history.

(56) References Cited

U.S. PATENT DOCUMENTS 6,659,623 B2 * 12/2003 Friend ..... 362/249.06

* cited by examiner

*Primary Examiner* — Jason Moon Han
(74) *Attorney, Agent, or Firm* — Rosenberg, Klein & Lee

(57) ABSTRACT

A custom assembly light-emitting module using plugs and jacks for obtaining vertical electrical connections, includes a light-emitting unit, a lens unit, a plug unit and a jack unit. The lens unit is detachably combined with the light-emitting unit. The plug unit is disposed beside one side of the lens unit and electrically connected with the light-emitting unit. The jack unit is disposed on a bottom side of the plug unit and electrically connected with the plug unit. In addition, the light-emitting unit has two first retaining structures being formed on two opposite lateral sides thereof, the lens unit has a hollow transparent structure and a lens integratedly with the hollow transparent structure, two second retaining structures are disposed in the hollow transparent structure, and the light-emitting unit is detachably disposed in the hollow transparent structure.

20 Claims, 12 Drawing Sheets

CUSTOM ASSEMBLY LIGHT-EMITTING MODULE USING PLUGS AND JACKS FOR OBTAINING VERTICAL ELECTRICAL CONNECTIONS

BACKGROUND OF THE INVENTION

1. Field of the Invention

The present invention relates to a light-emitting module, and particularly relates to a custom assembly light-emitting module using plugs and jacks for obtaining vertical electrical connections.

2. Description of Related Art

A traditional light-emitting device is used to provide illumination for humans, such as general illumination or illumination for enhancing the aspect of the environment. However, the characteristics of traditional light-emitting devices are fixed such as fixed heat-dissipating effect, fixed light-emitting effect, and fixed light-projecting angle.

When the user purchases a traditional light-emitting device, the components of the traditional light-emitting device cannot be replaced. In other words, because the characteristics of a traditional light-emitting device are fixed, the components of the traditional light-emitting device cannot be replaced according to the different user requirements.

SUMMARY OF THE INVENTION

One particular aspect of the present invention is to provide a custom assembly light-emitting module using plugs and jacks for obtaining vertical electrical connections that include a light-emitting unit and a lens unit that are replaceable according to the different user requirements. Hence, the light-emitting unit is replaceable according to different light-emitting effects, and the lens unit is replaceable according to different light-projecting angles. Moreover, the present invention has vertical electrical connections by matching a plug unit (plug pins) and a jack unit (jack pins).

In order to achieve the above-mentioned aspects, the present invention provides a custom assembly light-emitting module using plugs and jacks for obtaining vertical electrical connections, including: a light-emitting unit, a lens unit, a plug unit and a jack unit. The lens unit is detachably combined with the light-emitting unit. The plug unit is disposed beside one side of the lens unit and electrically connected with the light-emitting unit. The jack unit is disposed on a bottom side of the plug unit and electrically connected with the plug unit. In addition, the light-emitting unit has two first retaining structures respectively extended upwards from two opposite lateral sides thereof, the lens unit has a lens and two second retaining structures respectively formed on two opposite lateral sides of the lens, and the lens unit is detachably disposed above the light-emitting unit by matching the two first retaining structures and the two second retaining structures.

In order to achieve the above-mentioned aspects, the present invention provides a custom assembly light-emitting module using plugs and jacks for obtaining vertical electrical connections, including: a light-emitting unit, a lens unit, a plug unit and a jack unit. The lens unit is detachably combined with the light-emitting unit. The plug unit is disposed beside one side of the lens unit and electrically connected with the light-emitting unit. The jack unit is disposed on a bottom side of the plug unit and electrically connected with the plug unit. In addition, the light-emitting unit has two first retaining structures disposed on two opposite lateral sides thereof, the lens unit has a lens and two second retaining structures respectively extended downwards from two opposite lateral sides of the lens, and the lens unit is detachably disposed above the light-emitting unit by matching the two first retaining structures and the two second retaining structures.

In order to achieve the above-mentioned aspects, the present invention provides a custom assembly light-emitting module using plugs and jacks for obtaining vertical electrical connections, including: a light-emitting unit, a lens unit, a plug unit and a jack unit. The lens unit is detachably combined with the light-emitting unit. The plug unit is disposed beside one side of the lens unit and electrically connected with the light-emitting unit. The jack unit is disposed on a bottom side of the plug unit and electrically connected with the plug unit. In addition, the light-emitting unit has two first retaining structures are formed on two opposite lateral sides thereof, the lens unit has a hollow transparent structure and a lens integratedly with the hollow transparent structure, two second retaining structures are disposed in the hollow transparent structure, and the light-emitting unit is detachably disposed in the hollow transparent structure.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF PREFERRED EMBODIMENTS

Referring to FIGS. 1A to 1D, the first embodiment of the present invention provides a custom assembly light-emitting module using plugs and jacks for obtaining vertical electrical connections, including: a light-emitting unit 2*a*, a lens unit 4*a*, a plug unit 6*a* and a jack unit 8*a*.

The light-emitting unit 2*a* has a circuit substrate 20*a*, a retaining structure Ra disposed on a bottom side of the circuit substrate 20*a* for mating with the jack unit 8*a*, a plurality of light-emitting elements 21*a* electrically disposed on the circuit substrate 20*a*, and two first retaining structures 22*a* extended upwards from the bottom side of the circuit substrate 20*a* respectively (the two first retaining structures 22*a* are respectively extended upwards from two opposite lateral sides of the light-emitting unit 2*a*). Each first retaining structure 21*a* has a concave retaining portion 220*a* formed on its outside. In addition, the space, the color, the number and the power of the light-emitting elements 21*a* of the light-emitting unit 2*a* can be changed according to different user requirements.

The lens unit 4*a* has a lens 40*a* and two second retaining structures 41*a* respectively formed on two opposite lateral sides of the lens 40*a*. The two retaining structures 41*a* correspond to the two first retaining structures 22*a* respectively. Hence, the lens unit 4*a* is detachably disposed above the light-emitting unit 2*a* by matching the two first retaining structures 22*a* and the two second retaining structures 41*a*. In the first embodiment, the two first retaining structures 22*a* are two first sliding grooves facing each other, and the two second retaining structures 41*a* are two second sliding grooves in opposite direction to each other. The two first sliding grooves and the two second sliding grooves are matched to slide in each other. However, the matching relation between the two first sliding grooves and the two second sliding grooves is just an example. The lens unit 4*a* can be detachably disposed above the light-emitting unit 2*a* by any matching method. In other words, the lens unit 4*a* can be detachably combined with the light-emitting unit 2*a*.

Figure 1A:
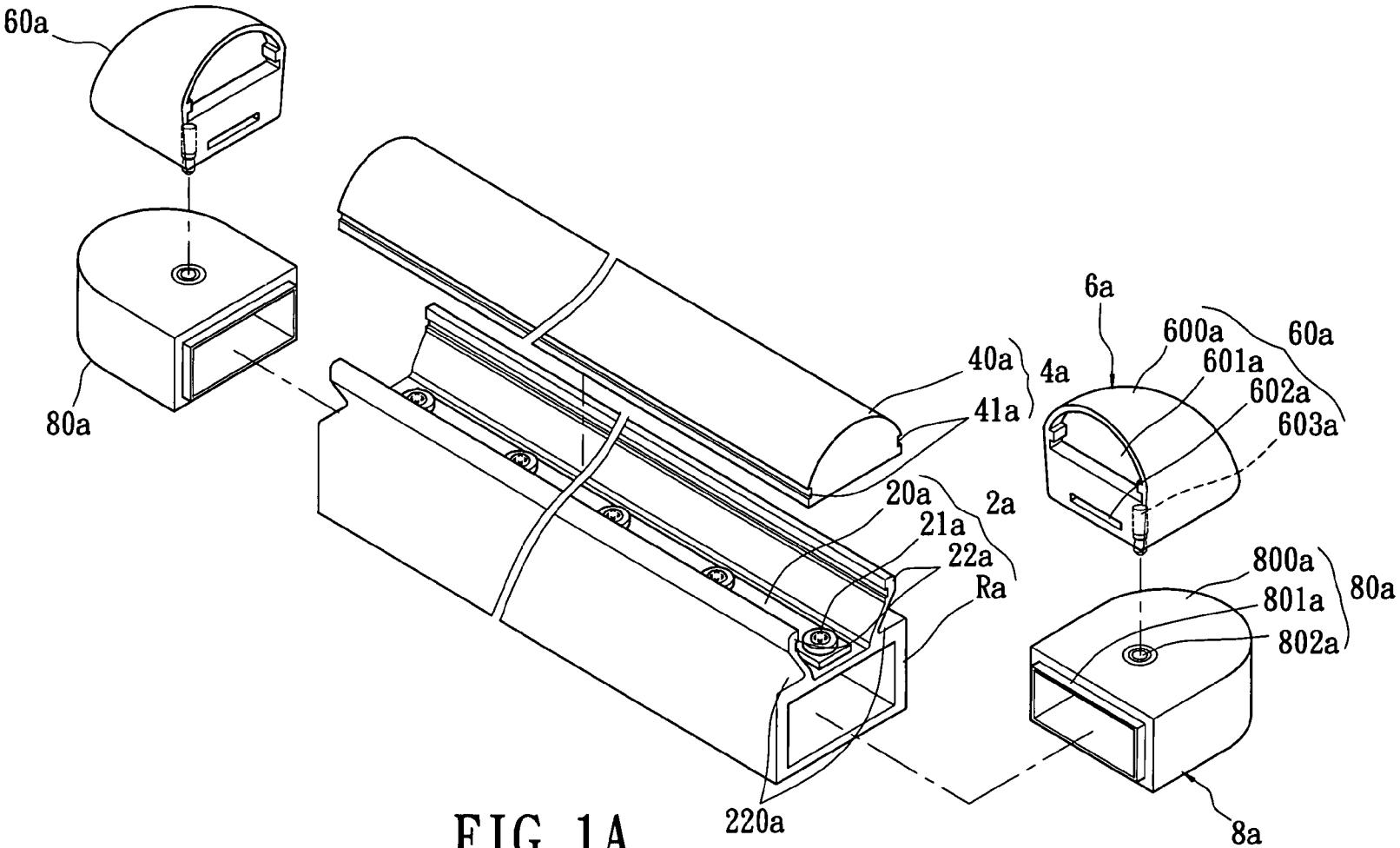
FIG. 1A is a perspective, exploded view of a custom assembly light-emitting module using plugs and jacks for obtaining vertical electrical connections according to the first embodiment of the present invention.
Figure 1B:
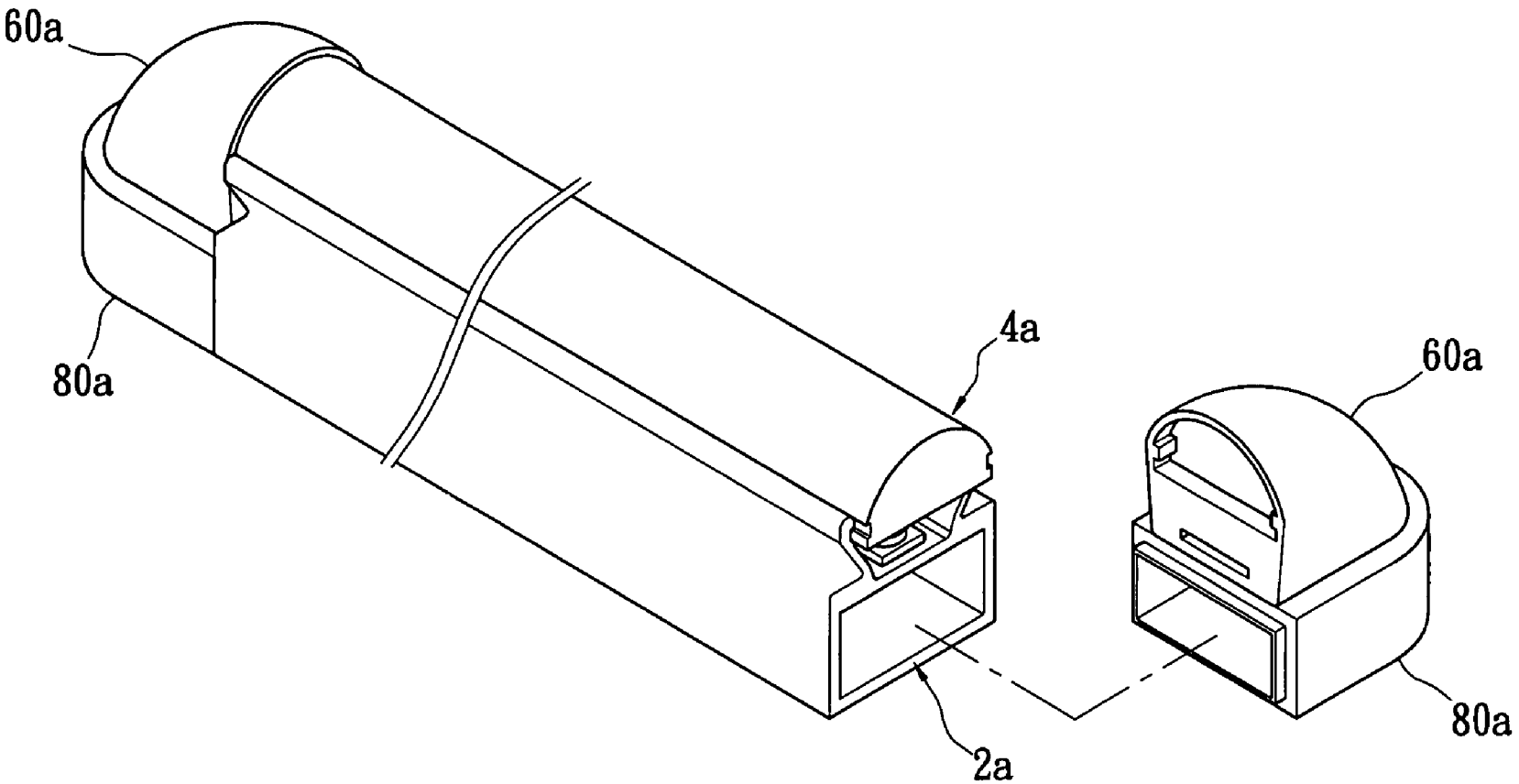
FIG. 1B is a perspective, assembled view of a custom assembly light-emitting module using plugs and jacks for obtaining vertical electrical connections according to the first embodiment of the present invention.
Figure 1C:
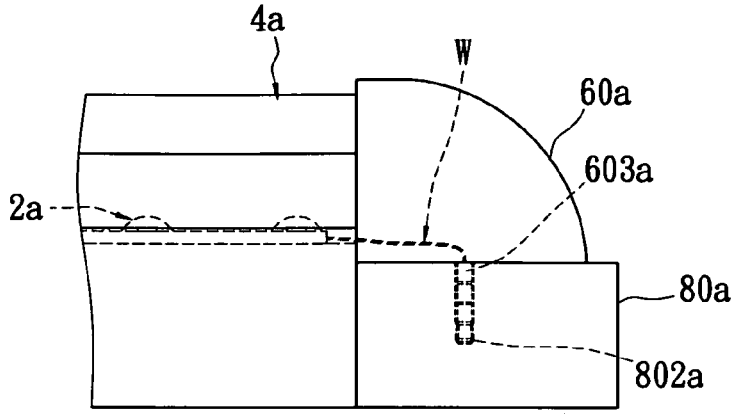
FIG. 1C is a lateral, schematic view of a custom assembly light-emitting module using plugs and jacks for obtaining vertical electrical connections according to the first embodiment of the present invention.

In addition, the plug unit 6*a* disposed beside one side of the lens unit 4*a* and electrically connected with the light-emitting unit 2*a* (as shown in FIG. 1C). The plug unit 6*a* has two plug connectors 60*a*. Each plug connector 60*a* has a plug body 600*a*, a first receiving space 601*a* formed in the plug body 600*a* for receiving one part of the lens unit 4*a*, a second receiving space 602*a* formed in the plug body 600*a*, and at least one plug pin 603*a* projected downwards from a bottom side of the plug body 600*a*. Moreover, the light-emitting unit 2*a* is electrically connected with one side of the plug pin 603*a* by at least one wire W or any conductive element passing through the second receiving space 602*a* (as shown in FIG. 1C).

Furthermore, the jack unit 8*a* is disposed on a bottom side of the plug unit 6*a* and is electrically connected with the plug unit 6*a*. The jack unit 8*a* has two jack connectors 80*a* respectively corresponding to the two plug connectors 60*a*. Each jack connector 80*a* has a jack body 800*a*, a retaining portion 801*a* formed on one side of the jack body 800*a* for mating with the retaining structure Ra, and at least one jack hole 802*a* disposed in the jack body 800*a* for electrically receiving the corresponding plug pin 603*a*. In the first embodiment, the retaining portion 801*a* is received and retained in the retaining structures Ra of the light-emitting unit 2*a*.

Figure 1D:
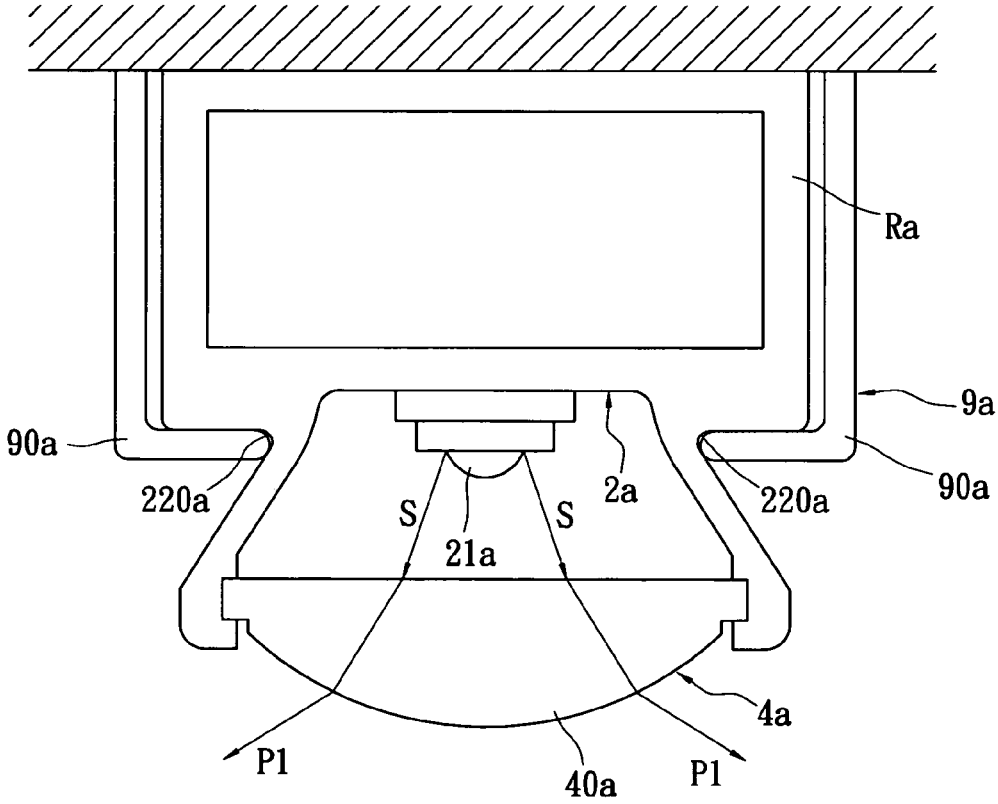
FIG. 1D is a lateral, schematic view of a custom assembly light-emitting module using plugs and jacks for obtaining vertical electrical connections fixed by a hooking unit according to the first embodiment of the present invention.

Referring to FIG. 1D, the light-emitting unit 2*a* is inverted and retained in a hooking unit 9*a* by the two concave retaining portions 220*a* mating with the hooking unit 9*a*. For example, when a user wants to place the custom assembly light-emitting module using plugs and jacks for obtaining vertical electrical connections of the present invention on a ceiling (or on a wall or on any object), the light-emitting unit 2*a* can be inverted and retained between two hooking structures 90*a* of the hooking unit 9*a* by matching the two concave retaining portions 220*a* and the hooking structures 90*a* fixed on the ceiling. The retaining structure Ra is hidden in the hooking unit 9*a*, and the lens 40*a* is exposed out of the hooking unit 9*a*. Hence, the light beams S generated by the light-emitting elements 21*a* pass through the lens 40*a* and generate upwards projecting light beams P1 with predetermined light-projecting angles so as to provide the brightness required by the different user requirements. In addition, the present invention can generate different light-projecting angles due to the replacement of the lens 40*a*.

Figure 1E:
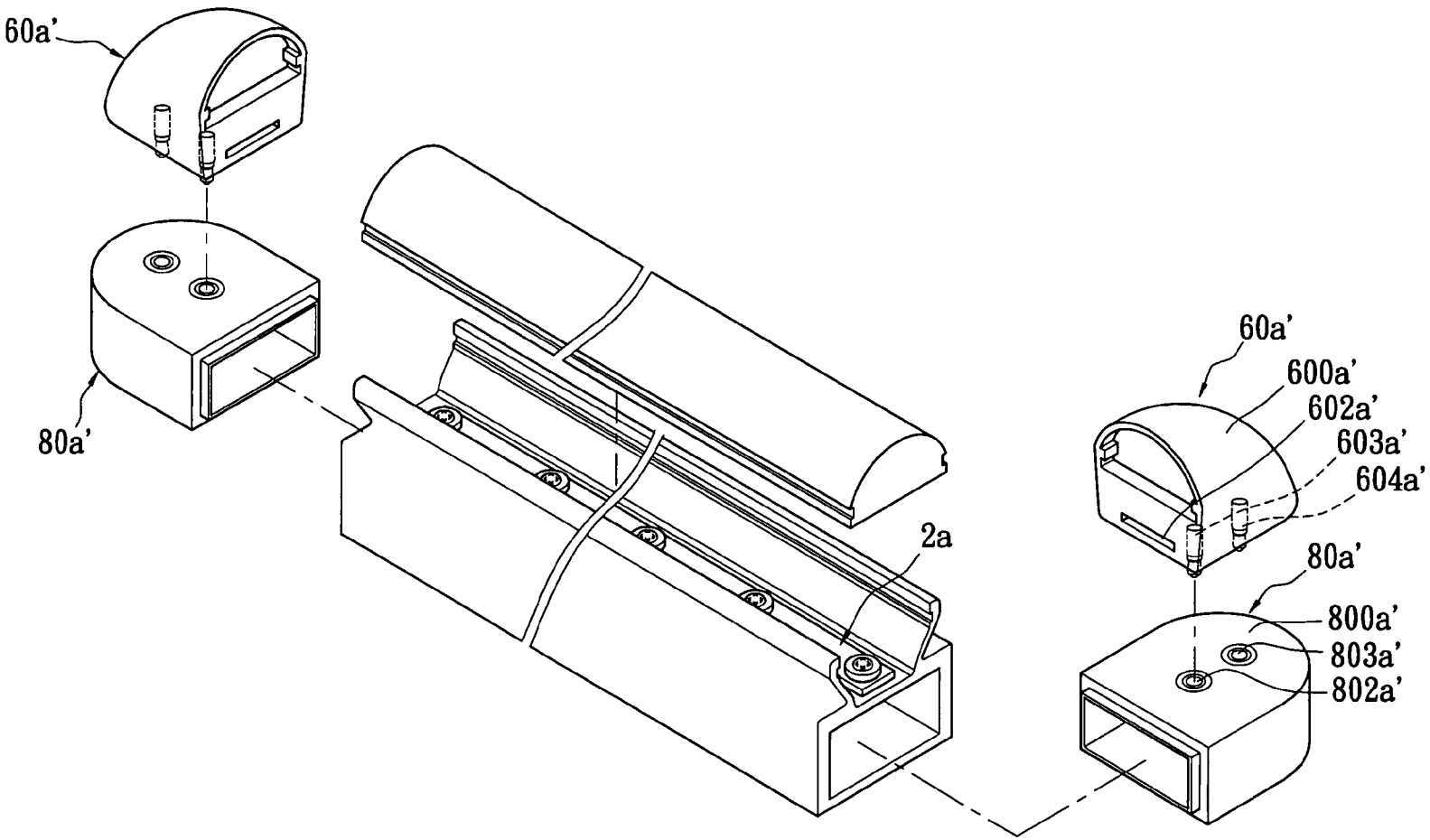
FIG. 1E is a perspective, exploded view of a custom assembly light-emitting module using plugs and jacks for obtaining vertical electrical connections according to the first embodiment of the present invention.

Referring to FIG. 1E, each plug connector 60*a*' has two plug pins (603*a*', 604*a*') projected downwards from a bottom side of the plug body 600*a*'. Moreover, the light-emitting unit 2*a* is electrically connected with one side of the two plug pins (603*a*', 604*a*') by at least one wire or any conductive element passing through the second receiving space 602*a*'. Furthermore, each jack connector 80*a*' has two jack holes (802*a*', 803*a*') disposed in the jack body 800*a*' for electrically receiving the corresponding two plug pin (603*a*', 604*a*').

Therefore, the light-emitting frequency, the light-emitting intensity or the color variation of the light-emitting unit 2*a* may be adjusted by matching the two plug pins (603*a*', 604*a*') and the two jack holes (802*a*', 803*a*') in order to generate various light-emitting effects. However, above-mentioned number of the plug pins (603*a*', 604*a*') and jack holes (802*a*', 803*a*') is just an example. The present invention can use many plug pins to mate with many jack holes.

Figure 2A:
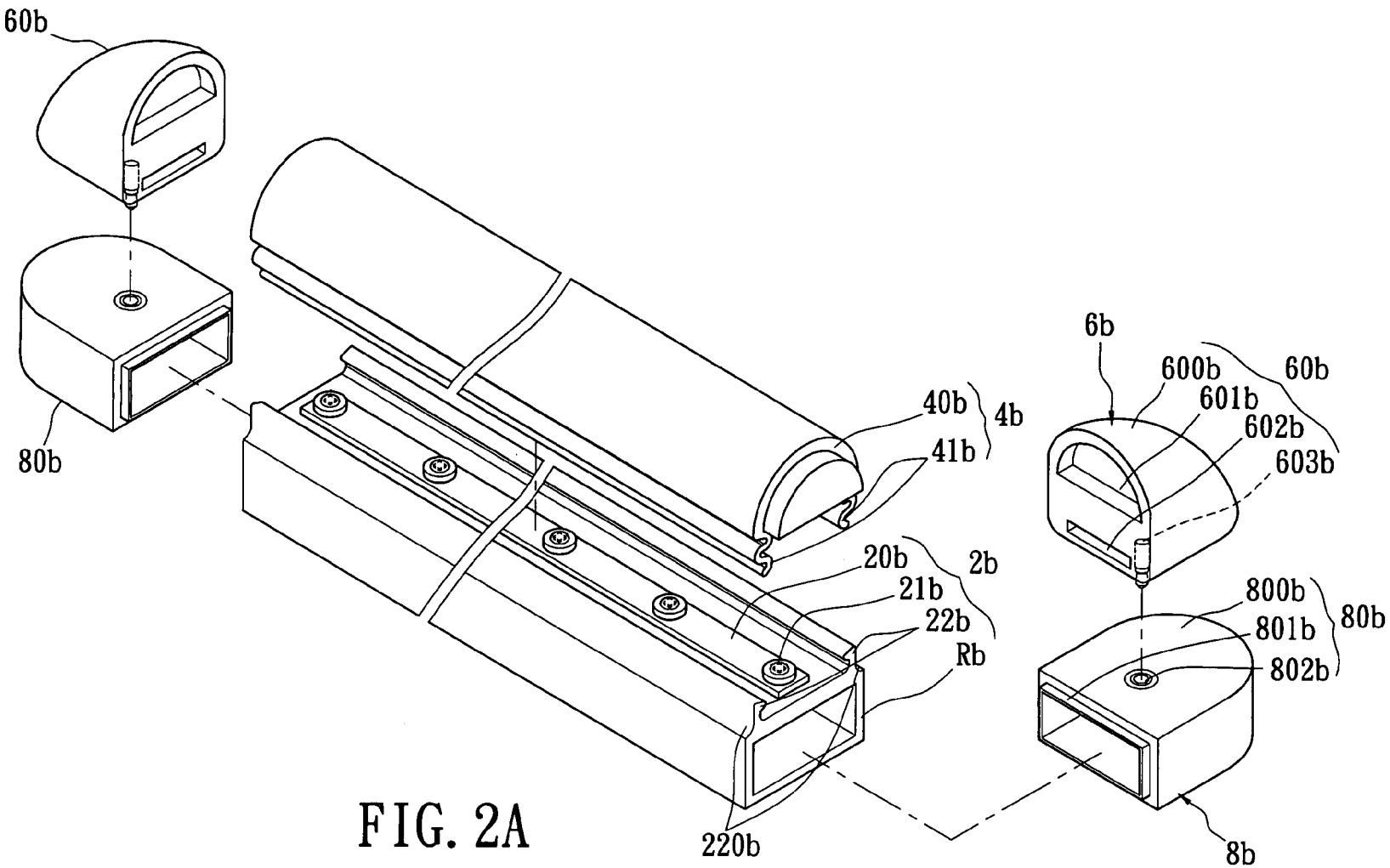
FIG. 2A is a perspective, exploded view of a custom assembly light-emitting module using plugs and jacks for obtaining vertical electrical connections according to the second embodiment of the present invention.
Figure 2B:
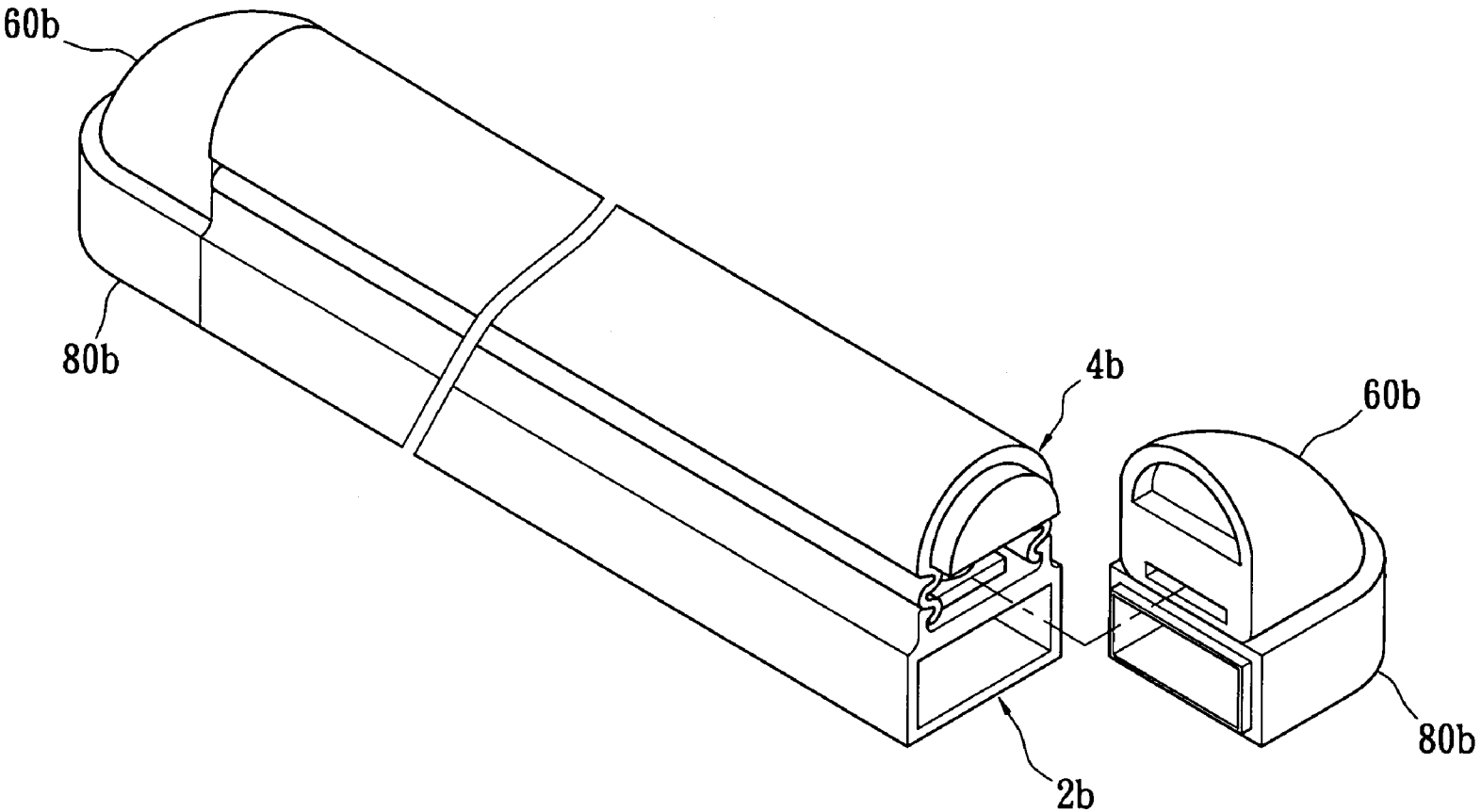
FIG. 2B is a perspective, assembled view of a custom assembly light-emitting module using plugs and jacks for obtaining vertical electrical connections according to the second embodiment of the present invention.
Figure 2C:
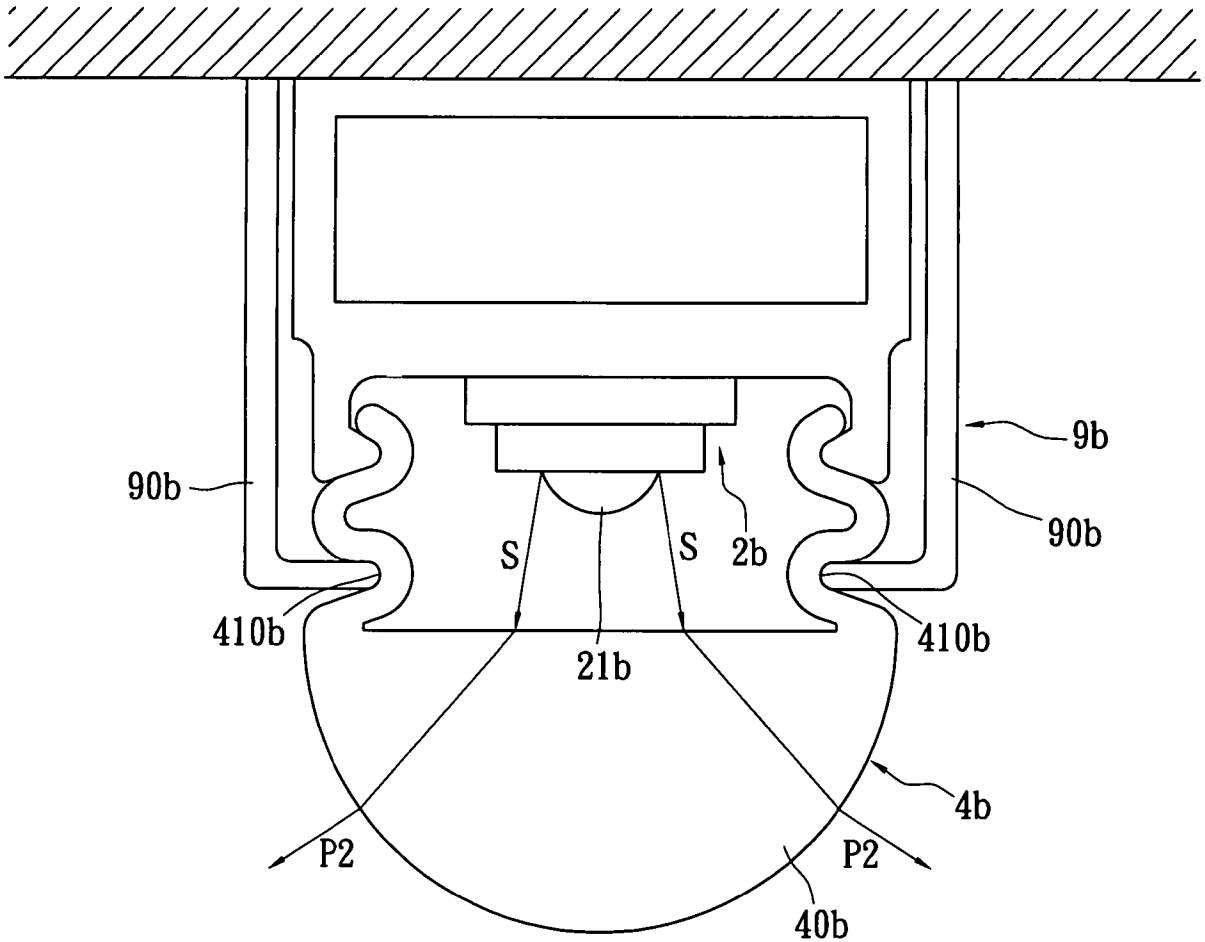
FIG. 2C is a lateral, schematic view of a custom assembly light-emitting module using plugs and jacks for obtaining vertical electrical connections fixed by a hooking unit according to the second embodiment of the present invention.

Referring to FIGS. 2A to 2C, the second embodiment of the present invention provides a custom assembly light-emitting module using plugs and jacks for obtaining vertical electrical connections, including: a light-emitting unit 2*b*, a lens unit 4*b*, a plug unit 6*b* and a jack unit 8*b*.

The light-emitting unit 2*b* has a circuit substrate 20*b*, a retaining structure Rb disposed on a bottom side of the circuit substrate 20*b* for mating with the jack unit 8*b*, a plurality of light-emitting elements 21*b* electrically disposed on the circuit substrate 20*b*, and two first retaining structures 22*b* extended upwards from the bottom side of the circuit substrate 20*b* respectively (the two first retaining structures 22*b* are respectively extended upwards from two opposite lateral sides of the light-emitting unit 2*b*). In addition, the space, the color, the number and the power of the light-emitting elements 21*b* of the light-emitting unit 2*b* can be changed according to different user requirements.

The lens unit 4*b* has a lens 40*b* and two second retaining structures 41*b* respectively extended downwards from two opposite lateral sides of the lens 40*b*. Each second retaining structure 41*b* has a concave retaining portion 410*b* formed on its outside. The two second retaining structures 41*b* correspond to the two first retaining structures 22*b* respectively. Hence, the lens unit 4*b* is detachably disposed above the light-emitting unit 2*b* by matching the two first retaining structures 22*b* and the two second retaining structures 41*b*. In the second embodiment, the two first retaining structures 22*b* are two first sliding grooves facing each other, the two second retaining structures 41*b* are two second sliding grooves in opposite direction to each other, and the two first sliding grooves and the two second sliding grooves are matched to slide in each other. However, the matching relation between the two first sliding grooves and the two second sliding grooves is just an example. The lens unit 4*b* can be detachably disposed above the light-emitting unit 2*b* by any matching method. In other words, the lens unit 4*b* can be detachably combined with the light-emitting unit 2*b*.

In addition, the plug unit 6*b* disposed beside one side of the lens unit 4*b* and electrically connected with the light-emitting unit 2*b*. The plug unit 6*b* has two plug connectors 60*b*. Each plug connector 60*b* has a plug body 600*b*, a first receiving space 601*b* formed in the plug body 600*b* for receiving one part of the lens unit 4*b*, a second receiving space 602*b* formed in the plug body 600*b*, and at least one plug pin 603*b* projected downwards from a bottom side of the plug body 600*b*. Moreover, the light-emitting unit 2*b* is electrically connected with one side of the plug pin 603*b* by at least one wire or any conductive element passing through the second receiving space 602*b*.

Furthermore, the jack unit 8*b* is disposed on a bottom side of the plug unit 6*b* and is electrically connected with the plug unit 6*b*. The jack unit 8*b* has two jack connectors 80*b* respectively corresponding to the two plug connectors 60*b*. Each jack connector 80*b* has a jack body 800*b*, a retaining portion 801*b* formed on one side of the jack body 800*b* for mating with the retaining structure Rb, and at least one jack hole 802*b* disposed in the jack body 800*b* for electrically receiving the corresponding plug pin 603*b*. In the second embodiment, the retaining portion 801*b* is received and retained in the retaining structures Rb of the light-emitting unit 2*b*.

Referring to FIG. 2C, the lens unit 4*b* is inverted and retained under a hooking unit 9*b* by the two concave retaining portions 410*b* matching with the hooking unit 9*b*. For example, when a user wants to place the custom assembly light-emitting module using plugs and jacks for obtaining vertical electrical connections of the present invention on a ceiling (or on a wall or on any object), the light-emitting unit 2*b* can be inverted and retained between two hooking structures 90*b* of the hooking unit 9*b* by matching the two concave retaining portions 410*b* and the hooking structures 90*b* fixed on the ceiling. The light-emitting unit 2*b* is hidden in the hooking unit 9*b*, and the lens 40*b* is exposed out of the hooking unit 9*b*. Hence, the light beams S generated by the light-emitting elements 21*b* pass through the lens 40*b* and generate upwards projecting light beams P2 with predetermined light-projecting angles, so that the light beams P2 is available to provide brightness required by the different user requirements. In addition, the present invention can generate different light-projecting angles due to the replacement of the lens 40*b*.

Figure 2D:
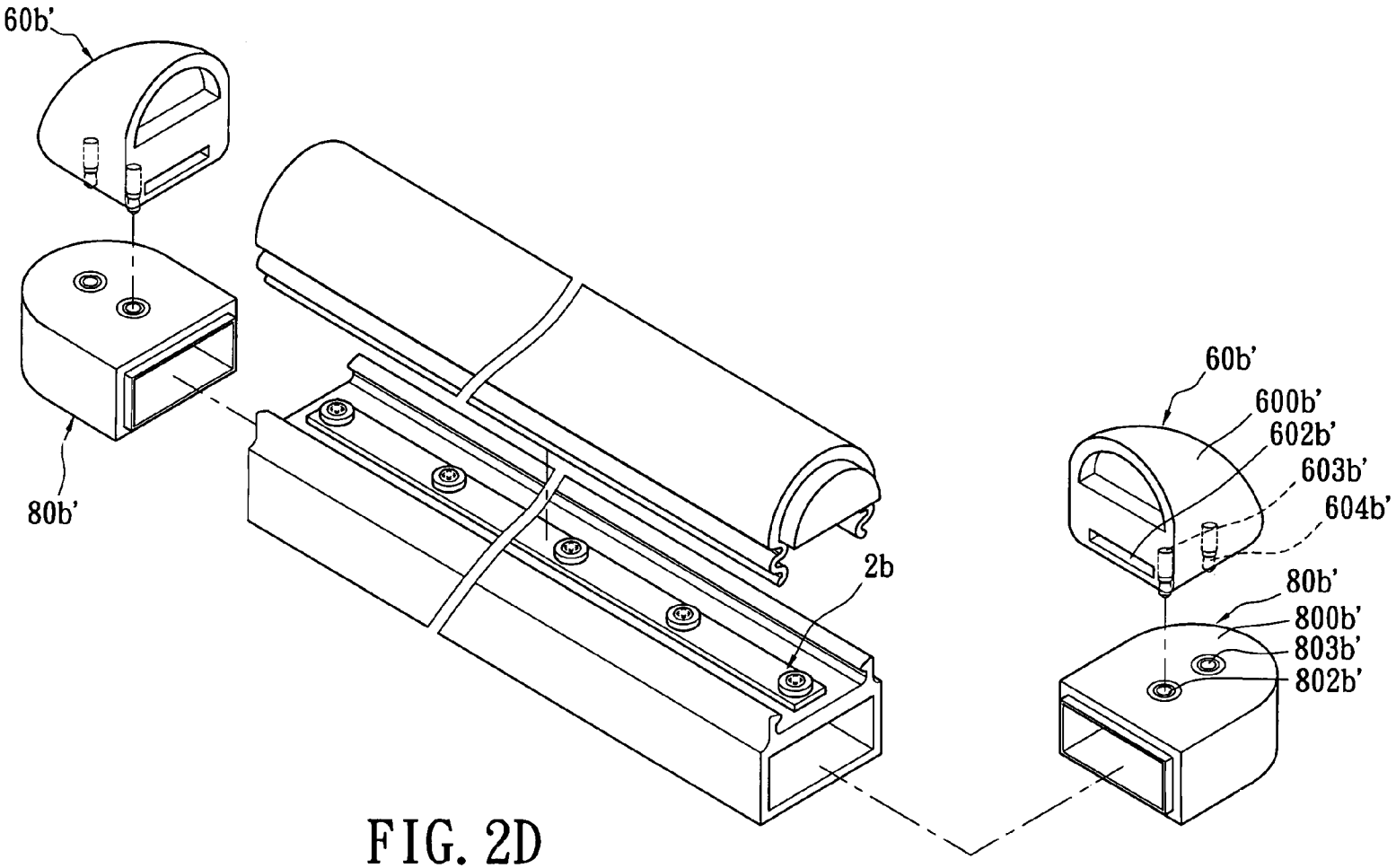
FIG. 2D is a perspective, exploded view of a custom assembly light-emitting module using plugs and jacks for obtaining vertical electrical connections according to the second embodiment of the present invention.

Referring to FIG. 2D, each plug connector 60*b*' has two plug pins (603*b*', 604*b*') projected downwards from a bottom side of the plug body 600*b*'. Moreover, the light-emitting unit 2*b* is electrically connected with one side of the two plug pins (603*b*', 604*b*') by at least one wire or any conductive element passing through the second receiving space 602*b*'. Furthermore, each jack connector 80*b*' has two jack holes (802*b*', 803*b*') disposed in the jack body 800*b*' for electrically receiving the corresponding two plug pin (603*b*', 604*b*').

Therefore, the light-emitting frequency, the light-emitting intensity or the color variation of the light-emitting unit 2*b* may be adjusted by matching the two plug pins (603*b*', 604*b*') and the two jack holes (802*b*', 803*b*') and to generate various light-emitting effects. However, above-mentioned number of the plug pins (603*b*', 604*b*') and jack holes (802*b*', 803*b*') is just an example. The present invention can use many plug pins to mate with many jack holes.

Figure 3A:
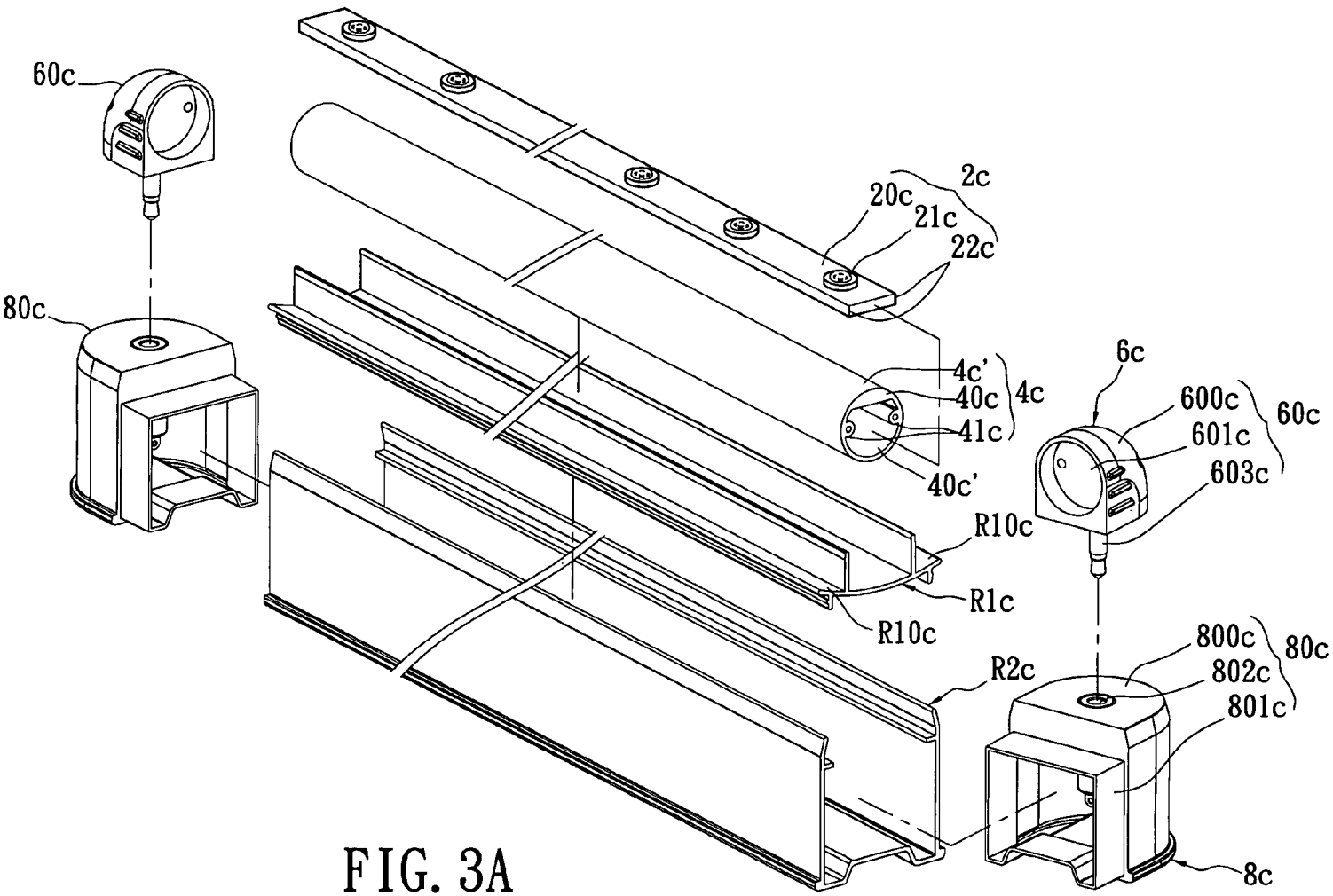
FIG. 3A is a perspective, exploded view of a custom assembly light-emitting module using plugs and jacks for obtaining vertical electrical connections according to the third embodiment of the present invention.
Figure 3B:
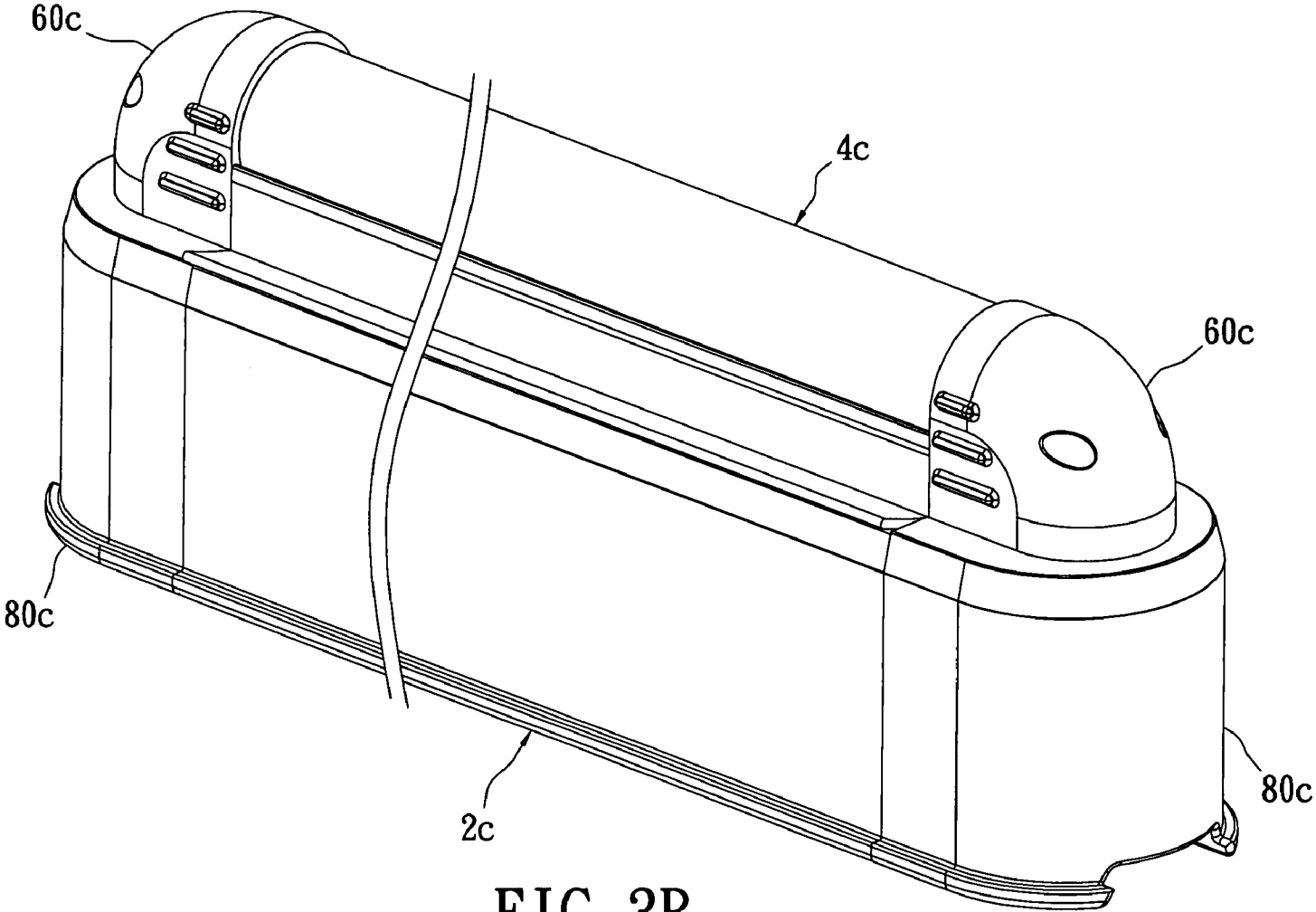
FIG. 3B is a perspective, assembled view of a custom assembly light-emitting module using plugs and jacks for obtaining vertical electrical connections according to the third embodiment of the present invention.
Figure 3C:
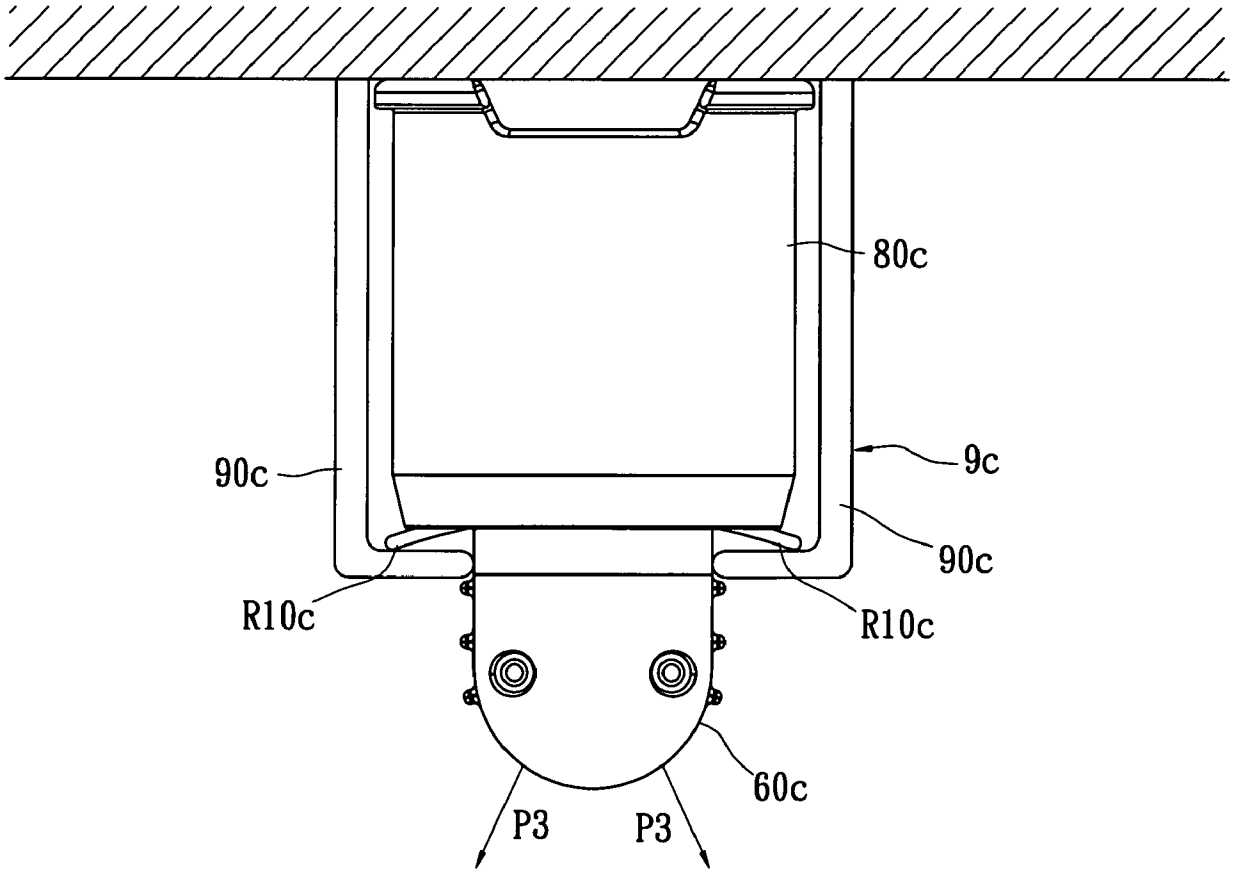
FIG. 3C is a lateral, schematic view of a custom assembly light-emitting module using plugs and jacks for obtaining vertical electrical connections fixed by a hooking unit according to the third embodiment of the present invention.

Referring to FIGS. 3A to 3C, the third embodiment of the present invention provides a custom assembly light-emitting module using plugs and jacks for obtaining vertical electrical connections, including: a light-emitting unit 2*c*, a lens unit 4*c*, a first retaining seat R1*c*, a second retaining seat R2*c*, a plug unit 6*c* and a jack unit 8*c*.

The light-emitting unit 2*c* is retained on the first retaining seat R1*c*, and the light-emitting unit 2*c* has a circuit substrate 20*c*, a plurality of light-emitting elements 21*c* electrically disposed on the circuit substrate 20*c*, and two first retaining structures 22*c* respectively disposed on two opposite lateral side of the circuit substrate 20*c*. In addition, the space, the color, the number and the power of the light-emitting elements 21*c* of the light-emitting unit 2*c* can be changed according to different user requirements.

The lens unit 4*c* has a hollow transparent structure 4*c*', a lens 40*c* integratedly with the hollow transparent structure 4*c*', and two second retaining structures 41*c* facing each other and disposed on an inner surface 40*c*' of the hollow transparent structure 4*c*' (the two second retaining structures 41*c* are disposed in the hollow transparent structure 4*c*', and the light-emitting unit 2*c* is detachably disposed in the hollow transparent structure 4*c*'). The lens 40*c* is disposed on a top side of the hollow transparent structure 4*c*' and is disposed above the light-emitting unit 2*c*. The two second retaining structures 41*c* correspond to the two first retaining structures 22*c* respectively. Hence, the lens unit 4*c* is detachably disposed in the hollow transparent structure 4*c*' by matching the two first retaining structures 22*c* and the two second retaining structures 41*c*. In the third embodiment, the two first retaining structures 22*c* are two first sliding grooves facing each other, and the two second retaining structures 41*c* are two second sliding grooves in opposite direction to each other and are disposed on an inner surface of the hollow transparent structure 4*c*'. The two first sliding grooves and the two second sliding grooves are matched to slide in each other.

The first retaining seat R1*c* is disposed under the hollow transparent structure 4*c*', and the first retaining seat R1*c* has two concave retaining portions R10*c* formed on its two opposite lateral side. The second retaining seat R2*c* is disposed under the first retaining seat R1*c*. The hollow transparent 4*c*' is retained on the first retaining seat R1*c*, and the first retaining seat R1*c* is retained on the second retaining seat R2*c*.

In addition, the plug unit 6*c* is disposed beside one side of the lens unit 4*c* and electrically connected with the light-emitting unit 2*c*. The plug unit 6*c* has two plug connectors 60*c*. Each plug connector 60*c* has a plug body 600*c*, a first receiving space 601*c* formed in the plug body 600*c* for receiving one part of the lens unit 4*c*, and at least one plug pin 603*c* projected downwards from a bottom side of the plug body 600*c*. Moreover, the light-emitting unit 2*c* is electrically connected with one side of the plug pin 603*c* by at least one wire or any conductive element passing through the first receiving space 601*c*.

Furthermore, the jack unit 8*c* is disposed on a bottom side of the plug unit 6*c* and is electrically connected with the plug unit 6*c*. The jack unit 8*c* has two jack connectors 80*c* respectively corresponding to the two plug connectors 60*c*. Each jack connector 80*c* has a jack body 800*c*, a retaining portion 801*c* formed on one side of the jack body 800*c* for mating with the second retaining seat R2*c*, and at least one jack hole 802*c* disposed in the jack body 800*c* for electrically receiving the corresponding plug pin 603*c*. In the third embodiment, the retaining portion 801*c* is received and retained in the second retaining seat R2*c* of the light-emitting unit 2*c*.

Referring to FIG. 3C, the lens unit 4*c* is inverted and retained under a hooking unit 9*c* by the two concave retaining portions R10*c* matching with the hooking unit 9*c*. For example, when a user wants to place the custom assembly light-emitting module using plugs and jacks for obtaining vertical electrical connections of the present invention on a ceiling (or on a wall or on any object), the light-emitting unit 2*c* can be inverted and retained between two hooking structures 90*c* of the hooking unit 9*c* by matching the two concave retaining portions R10*c* and the hooking structures 90*c* fixed on the ceiling. Hence, the light beams generated by the light-emitting elements 21*c* pass through the lens 40*c* and generate upwards projecting light beams P3 with predetermined light-projecting angles, so that the light beams P3 can provide the brightness required by the different user requirements. In addition, the present invention can generate different light-projecting angles due to the replacement of the lens 40*c*.

Figure 3D:
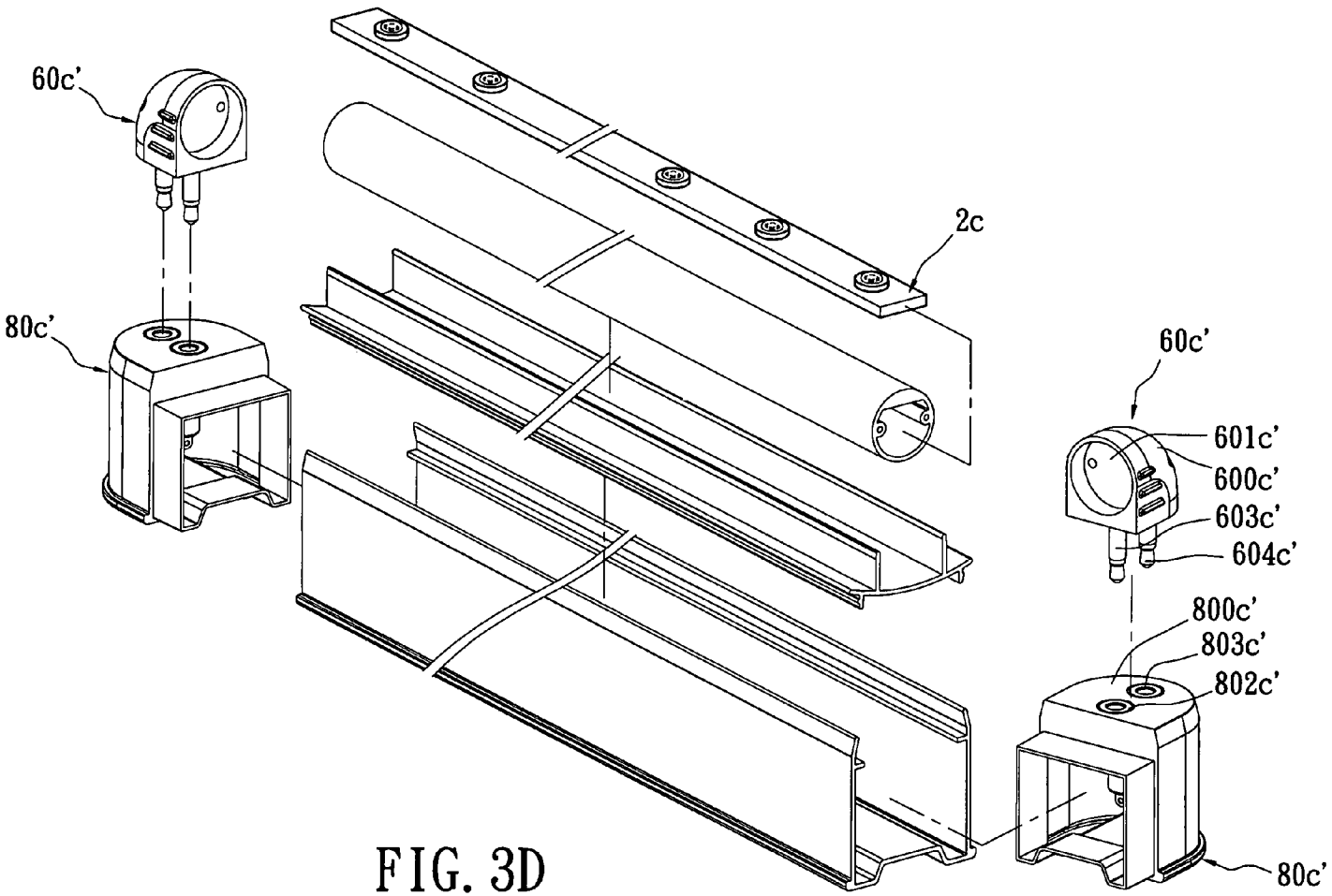
FIG. 3D is a perspective, exploded view of a custom assembly light-emitting module using plugs and jacks for obtaining vertical electrical connections according to the third embodiment of the present invention.

Referring to FIG. 3D, each plug connector 60*c*' has two plug pins (603*c*', 604*c*') projected downwards from a bottom side of the plug body 600*c*'. Moreover, the light-emitting unit 2*c* is electrically connected with one side of the two plug pins (603*c*', 604*c*') by at least one wire or any conductive element passing through the second receiving space 602*c*'. Furthermore, each jack connector 80*c*' has two jack holes (802*c*', 803*c*') disposed in the jack body 800*c*' in order to electrically receive the corresponding two plug pin (603*c*', 604*c*').

Therefore, the light-emitting frequency, the light-emitting intensity or the color variation of the light-emitting unit 2*c* may be adjusted by matching the two plug pins (603*c*', 604*c*') and the two jack holes (802*c*', 803*c*') in order to generate various light-emitting effects. However, above-mentioned number of plug pin and jack hole is just an example. The present invention can use many plug pins to mate with many jack holes.

In conclusion, the light-emitting unit is replaceable according to different light-emitting effects, and the lens unit is replaceable according to different light-projecting angles. Hence, the present invention has the following advantages:

1. The light-emitting unit is replaceable, so that the space, the color, the number and the power of the light-emitting elements can be changed according to different user requirements.

2. The lens unit is replaceable (the lens unit is detachably disposed above the light-emitting unit by matching the two first retaining structures and the two second retaining structures), so that the lens can be changed according to the different light-projecting angles required by the different user requirements.

3. In the first embodiment, the light-emitting unit 2*a* is inverted and retained in a hooking unit 9*a* by the two concave retaining portions 220*a* mating with the hooking unit 9*a*. Hence, the light beams S generated by the light-emitting elements 21*a* pass through the lens 40*a* and generate upwards projecting light beams P1 with predetermined light-projecting angles, so that the light beams can provide brightness required by the different user requirements.

4. In the second embodiment, the lens unit 4*b* is inverted and retained under a hooking unit 9*b* by the two concave retaining portions 410*b* matching with the hooking unit 9*b*. Hence, the light beams S generated by the light-emitting elements 21*b* pass through the lens 40*b* and generate upwards projecting light beams P3 with predetermined light-projecting angles, so that the light beams can provide brightness required by the different user requirements.

5. In the third embodiment, the two second retaining structures 41*c* correspond to the two first retaining structures 22*c* respectively. Hence, the lens unit 4*c* is detachably disposed in the hollow transparent structure 4*c*' by matching the two first retaining structures 22*c* and the two second retaining structures 41*c*.

6. The present invention has vertical electrical connections by matching the plug unit (the plug pins) and the jack unit (the jack pins).

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A custom assembly light-emitting module, comprising:

a light-emitting unit;

a lens unit detachably coupled to the light-emitting unit;

a plug unit including two plug connectors respectively disposed on two lateral ends of the light-emitting unit, wherein each plug connector includes a plug body and at least one plugging pin protrudingly projected from a bottom side of the plug body, and the light-emitting unit is electrically connected between the at least two plugging pins of the two plug connectors; and a jack unit including two jack connectors respectively corresponding to the two plug connectors, wherein each jack connector includes a jack body and at least one jack hole disposed in the jack body, and the at least two plugging pins of the two plug connectors are respectively detachably totally disposed into and electrically connected with the at least two jack holes of the two jack connectors.

2. The custom assembly light-emitting module as claimed in claim 1, wherein the light-emitting unit has two first retaining structures respectively extending upwards from two opposite lateral sides thereof, the lens unit has a lens and two second retaining structures respectively formed on two opposite lateral sides of the lens, and the lens unit is detachably disposed above the light-emitting unit by matching the two first retaining structures and the two second retaining structures.

3. The custom assembly light-emitting module as claimed in claim 2, wherein the light-emitting unit has a circuit substrate, a retaining structure disposed on a bottom side of the circuit substrate for mating with the jack unit, and a plurality of light-emitting elements electrically disposed on the circuit substrate, the two first retaining structures are respectively extending upwards from a bottom side of the circuit substrate.

4. The custom assembly light-emitting module as claimed in claim 3, wherein the plug unit has two plug connectors, each plug connector has a plug body, a first receiving space formed in the plug body for receiving one part of the lens unit, a second receiving space formed in the plug body, and at least one plug pin projected downwards from a bottom side of the plug body, the light-emitting unit is electrically connected with one side of the plug pin.

5. The custom assembly light-emitting module as claimed in claim 4, wherein the jack unit has two jack connectors respectively corresponding to the two plug connectors, each jack connector has a jack body, a retaining portion formed on one side of the jack body for mating with the retaining structure, and at least one jack hole disposed in the jack body for electrically receiving the corresponding plug pin.

6. The custom assembly light-emitting module as claimed in claim 2, wherein the two first retaining structures are two first sliding grooves facing each other, the two second retaining structures are two second sliding grooves in opposite direction to each other, and the two first sliding grooves and the two second sliding grooves are matched to slide in each other.

7. The custom assembly light-emitting module as claimed in claim 2, wherein each first retaining structure has a concave retaining portion formed on its outside, and the light-emitting unit is inverted and retained in a hooking unit by the two concave retaining portions mating with the hooking unit.

8. The custom assembly light-emitting module as claimed in claim 1, wherein the light-emitting unit has two first retaining structures disposed on two opposite lateral sides thereof, the lens unit has a lens and two second retaining structures respectively extending downwards from two opposite lateral sides of the lens, and the lens unit is detachably disposed above the light-emitting unit by matching the two first retaining structures and the two second retaining structures.

9. The custom assembly light-emitting module as claimed in claim 8, wherein the light-emitting unit has a circuit substrate, a retaining structure disposed on a bottom side of the circuit substrate for mating with the jack unit, and a plurality of light-emitting elements electrically disposed on the circuit substrate, and the two first retaining structures are respectively extending upwards from a bottom side of the circuit substrate.

10. The custom assembly light-emitting module as claimed in claim 9, wherein the plug unit has two plug connectors, each plug connector has a plug body, a first receiving space formed in the plug body for receiving one part of the lens unit, a second receiving space formed in the plug body, and at least one plug pin projected downwards from a bottom side of the plug body, the light-emitting unit is electrically connected with one side of the plug pin.

11. The custom assembly light-emitting module as claimed in claim 10, wherein the jack unit has two jack connectors respectively corresponding to the two plug connectors, each jack connector has a jack body, a retaining portion formed on one side of the jack body for mating with the retaining structure, and at least one jack hole disposed in the jack body for electrically receiving the corresponding plug pin.

12. The custom assembly light-emitting module as claimed in claim 8, wherein the two first retaining structures are two first sliding grooves facing each other, the two second retaining structures are two second sliding grooves in opposite direction to each other, and the two first sliding grooves and the two second sliding grooves are matched to slide in each other.

13. The custom assembly light-emitting module as claimed in claim 8, wherein each second retaining structure has a concave retaining portion formed on its outside, and the lens unit is inverted and retained under a hooking unit by the two concave retaining portions mating with the hooking unit.

14. The custom assembly light-emitting module as claimed in claim 1, wherein the light-emitting unit has two first retaining structures are formed on two opposite lateral sides thereof, wherein the lens unit has a hollow transparent structure and a lens integrally formed with the hollow transparent structure, and two second retaining structures are disposed in the hollow transparent structure, and the light-emitting unit is detachably disposed in the hollow transparent structure by matching the two first retaining structures and the two second retaining structures.

15. The custom assembly light-emitting module as claimed in claim 14, wherein the lens is disposed on a top side of the hollow transparent structure and is disposed above the light-emitting unit, and the two second retaining structures face each other and are disposed on an inner surface of the hollow transparent structure.

16. The custom assembly light-emitting module as claimed in claim 14, further comprising: a first retaining seat disposed on a bottom side of the hollow transparent structure and a second retaining seat disposed on a bottom side of the first retaining seat, wherein the hollow transparent structure is retained on the first retaining seat, and the first retaining seat is retained on the second retaining seat, wherein two end parts of the second retaining seat are respectively covered by the two jack bodies of the two jack connectors.

17. The custom assembly light-emitting module as claimed in claim 16, wherein the first retaining seat has two concave retaining portions formed on two opposite lateral sides thereof, and the lens unit is inverted and retained under a hooking unit by mating the two concave retaining portions with the hooking unit.

18. The custom assembly light-emitting module as claimed in claim 14, wherein the light-emitting unit has a circuit substrate and a plurality of light-emitting elements electrically connected to and disposed on the circuit substrate, and the two first retaining structures are respectively disposed on two opposite lateral sides of the circuit substrate.

19. A custom assembly light-emitting module, comprising:

a hollow transparent structure;

a light-emitting unit detachably received in the hollow transparent structure;

a plug unit including two plug connectors respectively disposed on two lateral ends of the light-emitting unit, wherein each plug connector includes a plug body and at least one plugging pin protrudingly projected from a bottom side of the plug body, and the light-emitting unit is electrically connected between the at least two plugging pins of the two plug connectors; and a jack unit including two jack connectors respectively corresponding to the two plug connectors, wherein each jack connector includes a jack body and at least one jack hole disposed in the jack body, and the at least two plugging pins of the two plug connectors are respectively detachably totally disposed into and electrically connected with the at least two jack holes of the two jack connectors.

20. The custom assembly light-emitting module as claimed in claim 19, further comprising: a first retaining seat disposed on a bottom side of the hollow transparent structure and a second retaining seat disposed on a bottom side of the first retaining seat, wherein the hollow transparent structure is retained on the first retaining seat, and the first retaining seat is retained on the second retaining seat, wherein two end parts of the second retaining seat are respectively covered by the two jack bodies of the two jack connectors.

* * * * *